US010801130B2

(12) United States Patent
Hegenbarth et al.

(10) Patent No.: US 10,801,130 B2
(45) Date of Patent: Oct. 13, 2020

(54) PROCESS AND DEVICE FOR THE MELT SPINNING AND COOLING OF MULTIFILAMENT THREADS

(71) Applicant: OERLIKON TEXTILE GMBH & CO. KG, Remscheid (DE)

(72) Inventors: Jörg Hegenbarth, Remscheid (DE); Stefan Conrad, Remscheid (DE); Marc-André Herrndorf, Herne (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 285 days.

(21) Appl. No.: 15/568,589

(22) PCT Filed: Apr. 11, 2016

(86) PCT No.: PCT/EP2016/057881
§ 371 (c)(1),
(2) Date: Oct. 23, 2017

(87) PCT Pub. No.: WO2016/173828
PCT Pub. Date: Nov. 3, 2016

(65) Prior Publication Data

US 2018/0112333 A1 Apr. 26, 2018

(30) Foreign Application Priority Data

Apr. 25, 2015 (DE) ..... 10 2015 005 367

(51) Int. Cl.
*D01D 5/088* (2006.01)
*D01D 5/092* (2006.01)
*D01F 6/60* (2006.01)

(52) U.S. Cl.
CPC ..... *D01D 5/088* (2013.01); *D01D 5/092* (2013.01); *D01F 6/60* (2013.01)

(58) Field of Classification Search
CPC ..... D01D 5/088; D01D 5/092; D01F 6/60
See application file for complete search history.

(56) References Cited

U.S. PATENT DOCUMENTS 3,067,458 A * 12/1962 Dauchert ..... D01D 5/092 264/211.15
3,108,322 A * 10/1963 Tate ..... D01D 5/092 425/72.2

(Continued)

FOREIGN PATENT DOCUMENTS

DE 102012023002 * 5/2014
DE 102013012869 * 2/2015
DE 102013012869 A1 2/2015

*Primary Examiner* — Jeffrey M Wollschlager
(74) *Attorney, Agent, or Firm* — BainwoodHuang

(57) ABSTRACT

Techniques for melt spinning and cooling of multifilament polyamide threads are described. The process involves multiple filament bundles spun alongside one another and cooled down separately by streams of cooling air flowing radially from the outside to the inside. Streams of cooling air are produced from a blowing chamber connected to a pressure source. Exhaust gases that occur during the spinning are removed through exhaust openings before the cooling of the filament bundles. An air pressure is set within the blowing chamber in such a way that the exhaust gases in the vicinity of the filament bundles are blown out through the exhaust openings from the inside outwards. A blowing box is assigned a pressure setting means for setting an air pressure within the blowing chamber, by which an air pressure for blowing out the exhaust gases can be set at the exhaust openings of a connection adapter.

14 Claims, 10 Drawing Sheets

(56) References Cited

Figure 1:
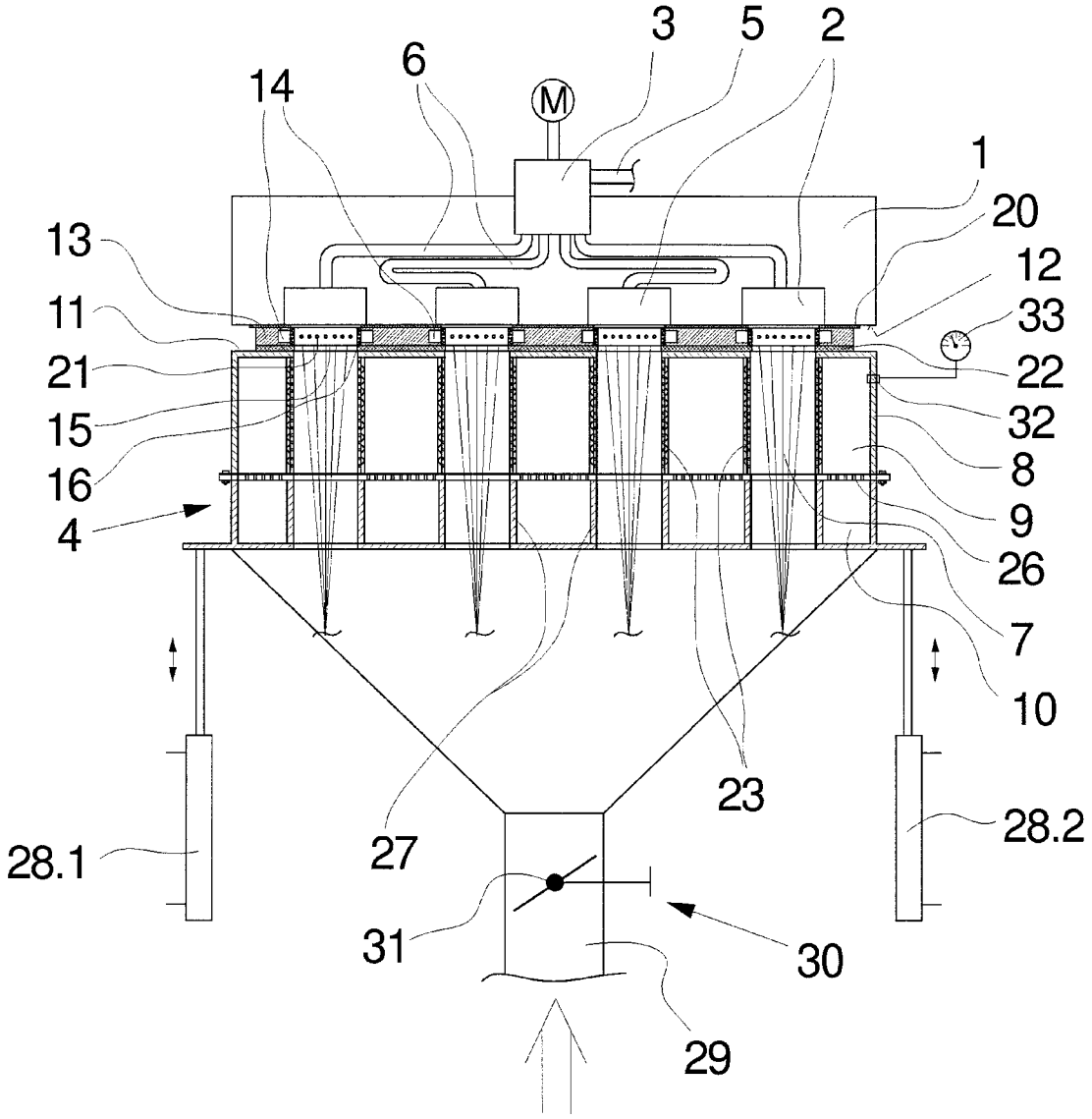

U.S. PATENT DOCUMENTS 3,274,644 A * 9/1966 Massey ..... D01D 5/092 425/72.2
3,672,801 A * 6/1972 Caldwell ..... D01D 5/092 425/71
4,204,828 A * 5/1980 Peckinpaugh ..... D01D 5/092 264/211.14
4,277,430 A * 7/1981 Peckinpaugh ..... D01D 5/092 264/129
4,405,297 A * 9/1983 Appel ..... D04H 3/16 425/72.2
4,702,871 A * 10/1987 Hasegawa ..... D01D 13/02 264/101
5,360,589 A 11/1994 Wandel et al.
5,935,512 A * 8/1999 Haynes ..... D01D 5/098 264/103
7,322,811 B2 * 1/2008 Schroter ..... D01D 7/00 425/382.2
7,384,583 B2 * 6/2008 Hisada ..... D01D 5/088 264/211.17
7,682,142 B2 * 3/2010 Lennemann ..... B65H 54/70 425/213
8,178,015 B2 * 5/2012 Harris ..... D01D 5/088 264/103
2006/0040008 A1 * 2/2006 Geus ..... D01D 5/088 425/72.2
2006/0145385 A1 * 7/2006 Fujii ..... D01D 5/092 264/130
2007/0057414 A1 * 3/2007 Hartge ..... D01D 5/092 264/555
2007/0138686 A1 * 6/2007 Reutter ..... D01D 5/08 264/103
2007/0284776 A1 * 12/2007 Hisada ..... D01D 5/088 264/211.22
2009/0026647 A1 * 1/2009 Geus ..... D01D 5/14 264/40.6
2010/0062672 A1 * 3/2010 Fare' ..... D01D 5/0985 442/409
2014/0248384 A1 * 9/2014 Oesterwind ..... B65H 51/12 425/6

* cited by examiner

PROCESS AND DEVICE FOR THE MELT SPINNING AND COOLING OF MULTIFILAMENT THREADS

A method for melt spinning and cooling of multifilament threads of a polyamide and an apparatus for melt spinning and cooling of multifilament threads of a polyamide are disclosed herein.

In the production of synthetic threads, it is commonly known that a multiplicity of filaments, after extrusion through a spinneret, are cooled in a downstream cooling zone in order that the thermoplastic material of the filaments solidifies and thus the filaments can be combined to the multifilament thread. For the cooling of the freshly extruded filaments, a cooling air stream is generated and directed onto the filaments. In order to obtain an intensive cooling of the individual filament strands within the filament bundles in this case, systems have proved beneficial, in which the cooling air stream of the filaments is fed from outside to inside. A method of this type and an apparatus of this type are known, for instance, from DE 10 2013 012 869 A1.

In a known apparatus a blow box is disposed beneath a spinning beam which holds a plurality of spinnerets arranged in rows. The blow box has a plurality of cooling cylinders, which respectively form a plurality of inlet openings on a top side of the blow box and which have a gas-permeable wall. In this way, the filaments which are extruded through the spinnerets per thread are able to be guided through the cooling cylinders, so that a cooling air contained in the blow box flows through the walls of the cooling cylinders and cools the filaments.

In order to be able to evacuate waste gases which are generated in the extrusion of polyamide and which are formed of monomers and oligomers, the known apparatus has between the blow box and the spinning beam a connection adapter, which in an interspace between the spinneret and the blow box has a plurality of waste gas openings. The waste gas openings are connected to a suction chamber, which is connected to a suction device. Via the suction device, negative pressure is created in the suction chamber, so that the waste gases can be sucked in via the waste gas openings.

In the production of fine filaments, it has now been observed that the suction stream generated for the evacuation of the waste gases has a negative effect on the cooling of the filaments. Since fine filament counts can be cooled with relatively low air pressures in the blow chamber, via the suction stream of the waste gas evacuation a large part of the cooling air is sucked up counter to the running direction of the threads and is jointly evacuated. Although a reduction of the negative pressure in the suction chamber in the connection adapter reduces the fraction of the evacuated cooling air, there is the disadvantage that the waste gases are insufficiently evacuated and unwanted deposits materialize in the region of the connection adapter.

It is thus an object of the invention to provide a method for the melt spinning and cooling of multifilament threads of polyamide, and an apparatus for the melt spinning and cooling of multifilament threads of polyamide, of the generic type, with which threads with fine filaments, in particular, could be spun.

A further object of the invention lies in refining a method and an apparatus for the melt spinning and cooling multifilament threads of polyamide such that a high uniformity in the production of a multiplicity of threads is attainable.

Such an object may be achieved by a method having the features disclosed herein and by an apparatus having the features disclosed herein.

Advantageous refinements may be defined by the features and feature combinations disclosed herein.

The evacuation of the waste gases generated in the area surrounding the filaments is realized without an additional negative pressure source. Surprisingly, the cooling air stream flowing with the filaments in the thread direction creates no negative pressure effects in the region of the waste gas openings. On the contrary, by the adjustment of the air pressure in the blow chamber, a slight positive pressure was able to be created in the intermediate zone between spinneret and blow box, which positive pressure causes the waste gases to be blown out through the waste gas openings. The cooling air is thus advantageously able to be utilized to evacuate the waste gases and, in parallel, to cool the filaments. For this purpose, to the blow box is assigned a pressure adjusting means for the adjustment of an air pressure, by which means an air pressure for blowing out the waste gases at the waste gas openings can be set. The waste gases thus have to be collected and disposed of only outside the melt spinning apparatus.

A particular advantage of the invention lies in the fact that the cooling and evacuation of the waste gases can be realized uniformly at each spinneret. In this way, all threads produced in a spinning position are guided through cooling cylinders of a blow box and cooled. The air pressure set in the blow chamber is thus in force in each spinning site of the spinning position.

In order in particular to obtain reliable outblowing of the waste gases and sufficient cooling in dependence on the respective filament titer, that method variant in which the air pressure of the cooling air within the blow chamber is measured before the start of the process, and in which the air pressure is set to a set value for the outblowing of the waste gases and for the cooling of the filaments, is particularly advantageous.

For this purpose, an advantageous refinement of the apparatus according to the invention has a measuring port on the blow chamber, so that the air pressure within the blow chamber is measurable. The measuring port on the blow box can be utilized both for a stationary continuous pressure measurement or a brief pressure measurement included only at the start of the process.

Since, in practice, a plurality of spinning positions are operated side by side in parallel, that method variant in which the positive pressure of the cooling air within the blow chamber is set by an adjustable damper flap within an inflow is preferredly implemented. In this way, there is the possibility of connecting a multiplicity of blow boxes to a central pressure source.

The apparatus according to the invention is provided with that refinement thereof in which the pressure adjusting means is formed by an adjustable damper flap in a feed duct which opens in the blow box. In this way, the operator, directly at the start of the process, can vary the respective air pressure in the blow chamber and set it to a set value which is necessary for the outblowing of the waste gases and the cooling of the filaments.

In order that no mutual influencing occurs during the extrusion of the filament bundles, in particular in the transition zone between the spinneret and the cooling cylinder, that method variant in which the waste gases at the extruded filaments per filament bundle are collected in separate waste gas chambers and blown out through separate waste gas outlets is particularly advantageous. In this way, no retroactive influencing of the waste gas streams of adjacent spinning sites is possible.

For this purpose, the apparatus according to the invention is refined such that to the waste gas openings in the connection adapter are assigned, per spinneret, at least one of a plurality of waste gas sockets for blowing out the waste gases, wherein the waste gas openings open out into one of a plurality of waste gas chambers. In this way, via the connection adapter, a separate waste gas socket is able to be assigned to each spinneret.

In principle, there is also the possibility, however, of collecting the waste gases at the extruded filaments of all filament bundles in a common waste gas chamber and of blowing them out via a central waste gas outlet. This method variant is preferredly utilized if there is a large number of spinnerets per spinning position, for instance in a double-sided arrangement of the spinnerets.

The apparatus according to the invention is therefore refined such that to the waste gas openings within the connection adapter is assigned a common waste gas chamber, which is connected to a central waste gas socket for blowing out the waste gases. The waste gas socket can here extend over the entire width of the waste gas chamber.

Since the waste gases contain materials such as monomers and oligomers that are hazardous to health, that method variant of the method according to the invention in which the waste gases, after having been blown out, are collected in a waste gas store and disposed of is of particular importance. Thus the environment within a machine shed in which the melt spinning apparatuses are mounted remains free from contamination by the waste gases.

For disposal, the waste gases can be condensed, for instance, so that the monomers crystallize. Preferably, the disposal devices are separated from the waste gas store, so that the waste gases can be transported away, for instance, as a result of a pressure descent between the working store and the disposal station. The pressure descent can here be created by a suction device or a blowing device.

For this purpose, the waste gas store is directly coupled with a disposal station.

Alternatively, there is also the possibility, however, that the waste gases are blown directly into an external environment. In this case, the waste gases must be taken up from the external environment and evacuated. For this, in particular that refinement of the apparatus according to the invention in which the waste gas sockets open with their free ends in an external environment, and in which a suction socket connected to an extraction device and having a suction opening is assigned, at a distance apart, to the free ends of the waste gas sockets, has proved successful. It is herein essential that the distance between the suction socket and the waste gas sockets is chosen such that a suction stream of the suction socket does not influence the blow streams at the waste gas sockets. If a central waste gas socket is used, a suction socket can analogously be assigned thereto at a distance apart in order to take up the waste gases from the external environment.

The apparatus according to the invention is based on the fact that the spinnerets arranged on the bottom side of the spinning beam preferredly have a round nozzle plate, so that the connection adapter preferredly has coaxially aligned passages beneath the spinnerets. In order to enable a uniform evacuation of the waste gases over the whole of the periphery of the filament bundles, the waste gas openings in the connection adapter are of slotted, round or oval configuration, wherein they extend individually, for instance as a circumferential slot, or in plural, at the passages, coaxially to the cooling cylinders. The waste gases can thus be guided directly radially from outside to inside.

The method according to the invention and the apparatus according to the invention enable a simple process control in the production of polyamide threads. Both the evacuation of the waste gases and the cooling of the filaments can be adjusted according to the invention via a single pressure adjusting means. A mutual influencing of the waste gas stream and of the cooling stream are precluded. The air pressure within the blow chamber can be tuned and adjusted to the number of spinning sites present, to the filament titer, to the number of filaments per filament bundle and to the melt throughput, which latter influences, in particular, the generation of the waste gases.

Figure 2:
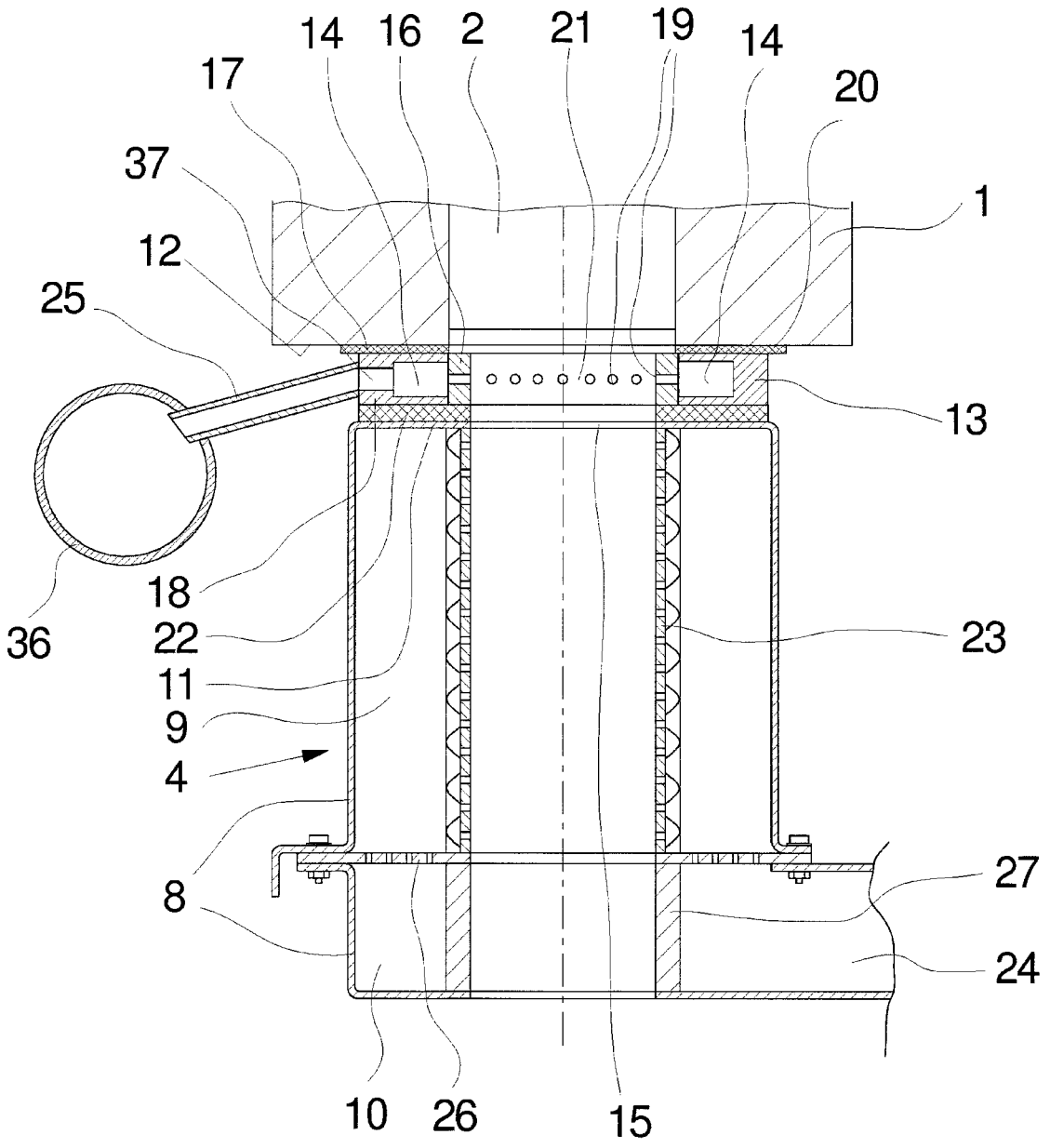
Figure 3:
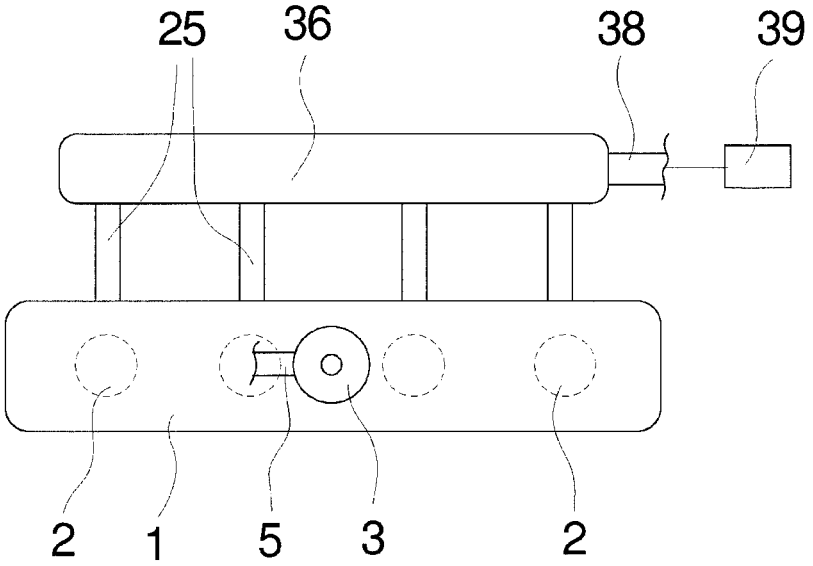
Figure 4:
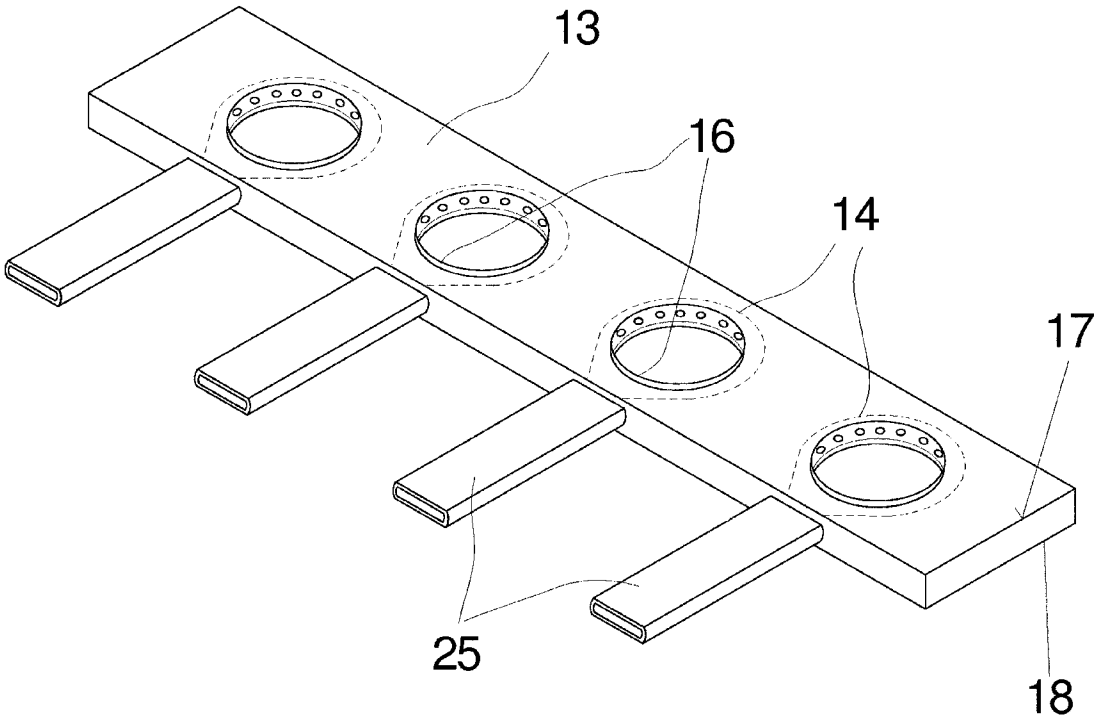
Figure 5:
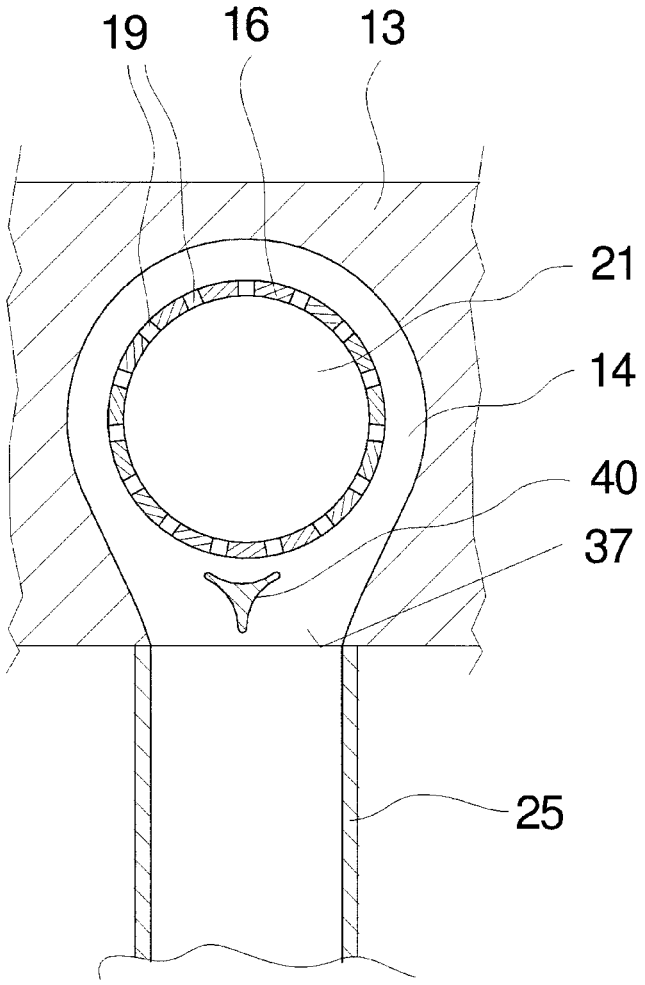
Figure 6:
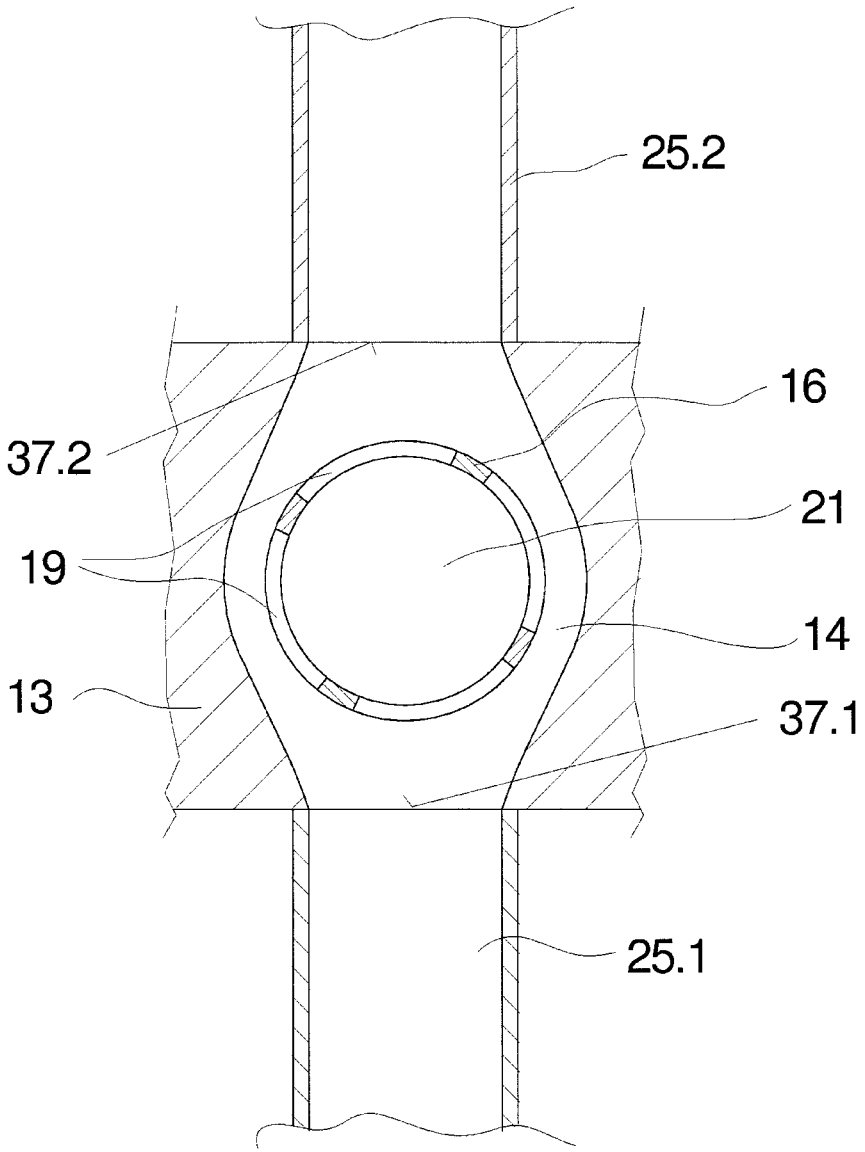
Figure 7:
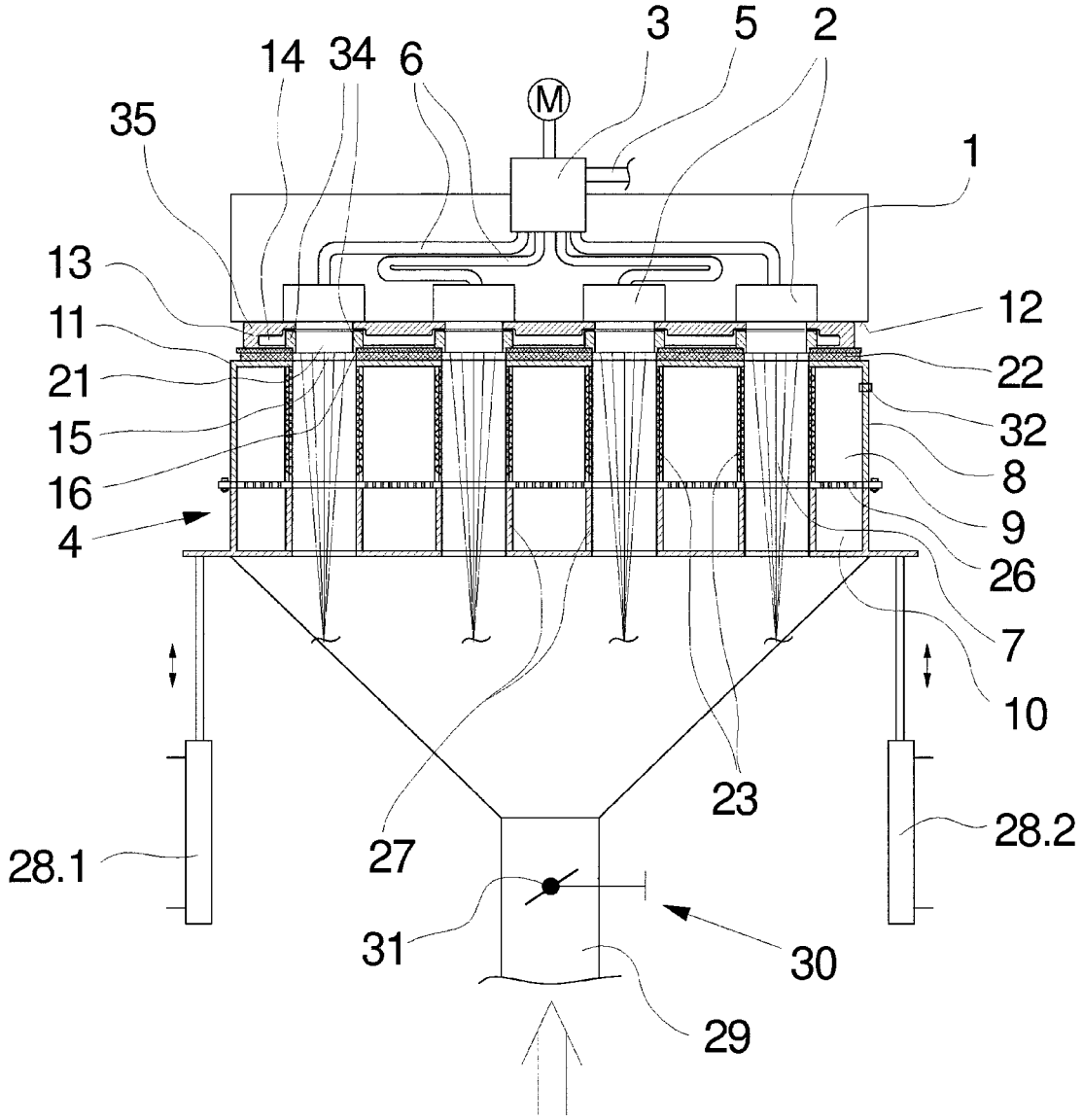
Figure 8:
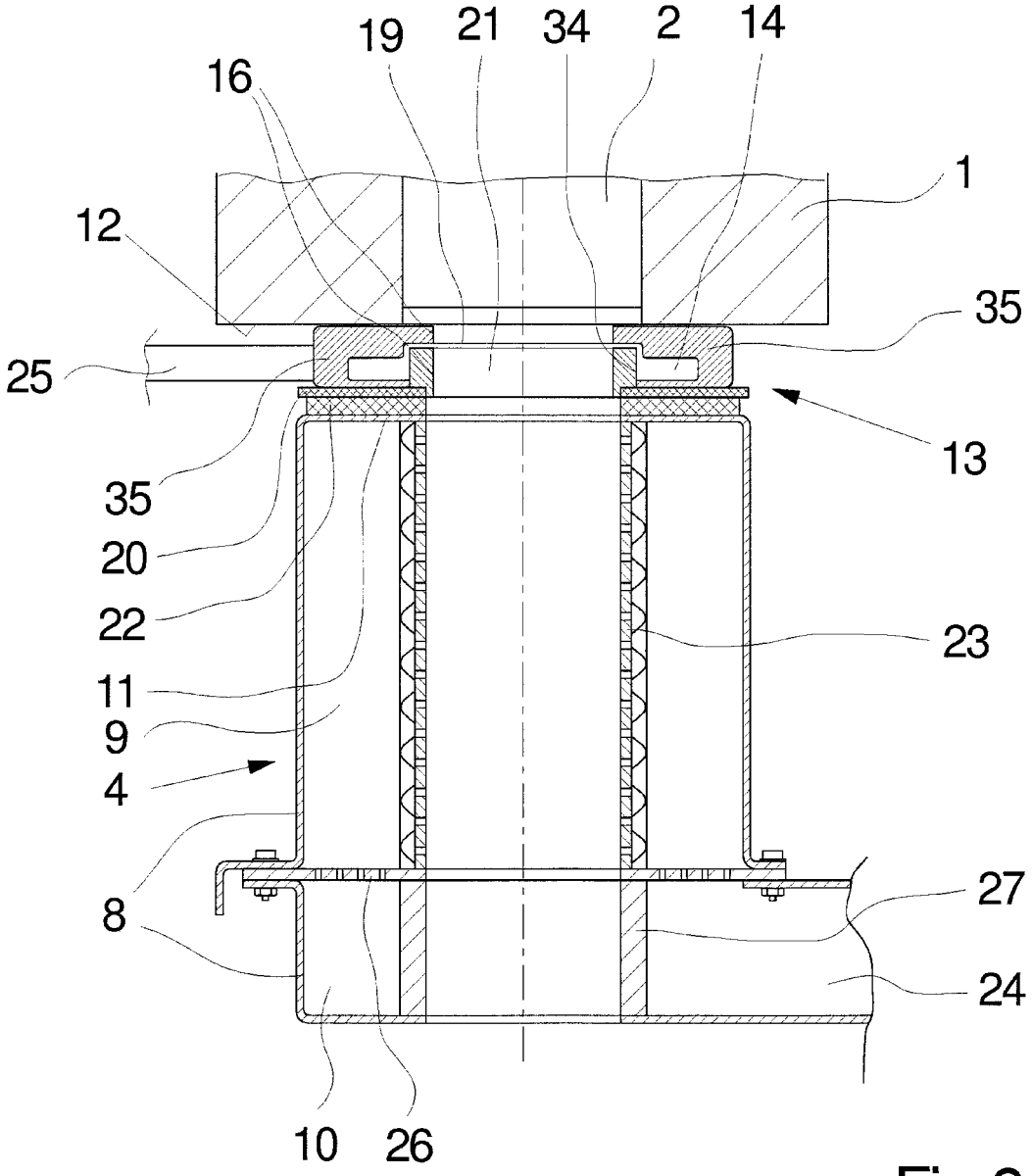
Figure 9:
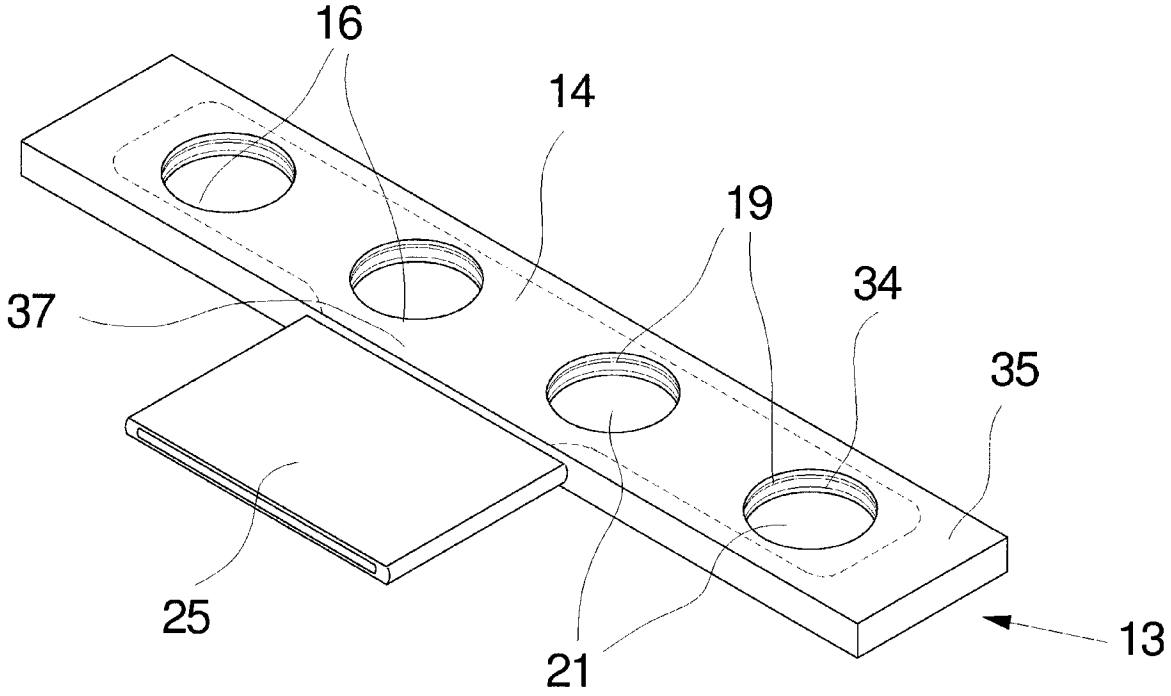
Figure 10:
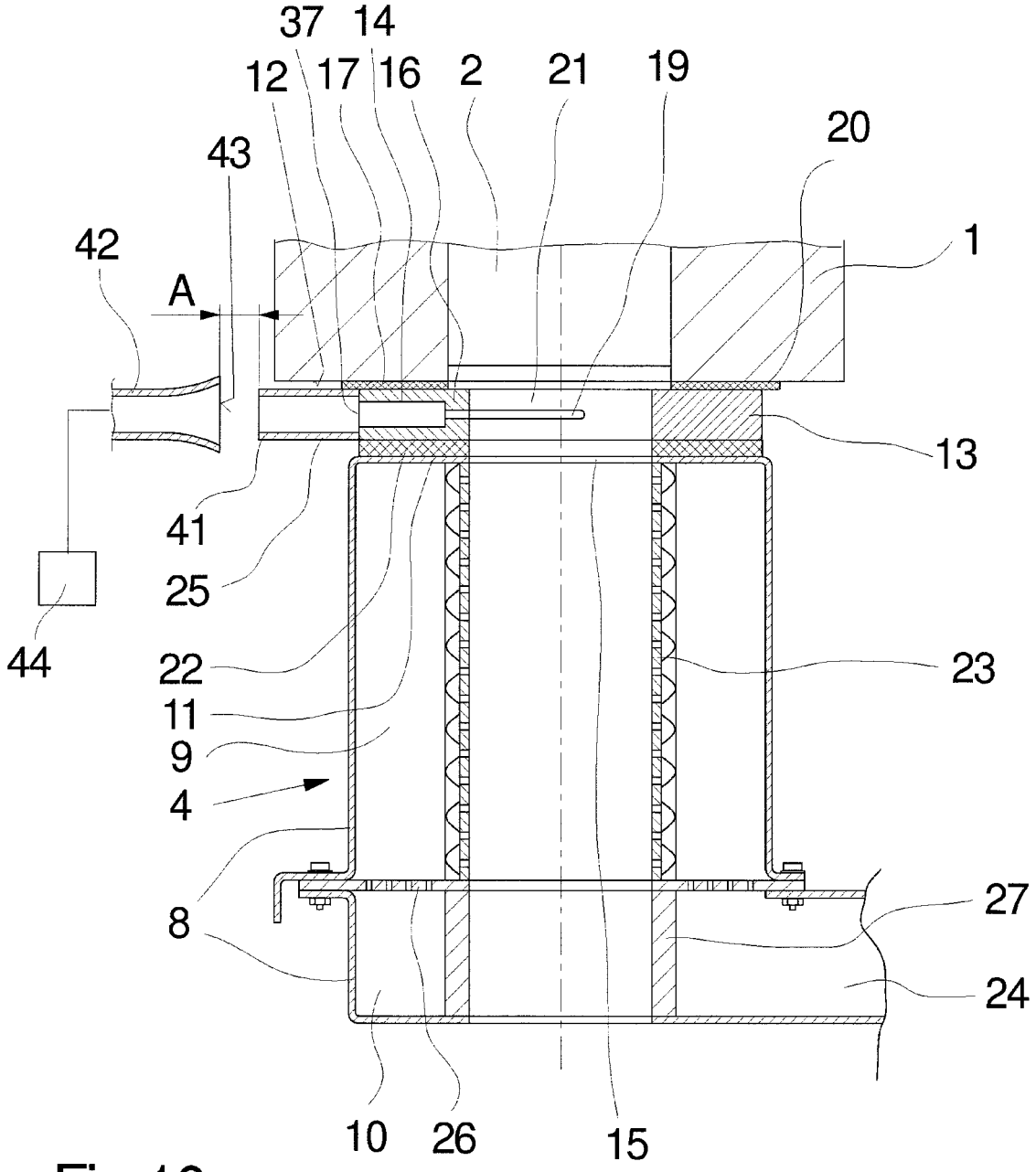

The method according to the invention is explained in greater detail below on the basis of some illustrative embodiments of the apparatus according to the invention with reference to the appended figures, wherein:

FIG. 1 represents schematically a longitudinal sectional view of a first illustrative embodiment of the apparatus according to the invention, FIG. 2 represents schematically a cross sectional view of the illustrative embodiment from FIG. 1, FIG. 3 represents schematically a top view of the illustrative embodiment from FIG. 1, FIG. 4 represents schematically a view of an illustrative embodiment of the connection adapter according to the illustrative embodiment according to FIG. 1, FIG. 5 represents schematically a sectional view of a passage on the connection adapter according to FIG. 4, FIG. 6 represents schematically a sectional view of a passage of a further illustrative embodiment of a connection adapter, FIG. 7 represents schematically a longitudinal sectional view of a further illustrative embodiment of the apparatus according to the invention, FIG. 8 represents schematically a cross sectional view of the illustrative embodiment from FIG. 7, FIG. 9 represents schematically a view of an illustrative embodiment of the connection adapter of the illustrative embodiment from FIG. 7, FIG. 10 represents schematically a cross sectional view of a further illustrative embodiment of the apparatus according to the invention.

In FIGS. 1, 2 and 3, a first illustrative embodiment of the apparatus according to the invention for the melt spinning and cooling of multifilament threads is represented in several views. FIG. 1 shows the illustrative embodiment in a longitudinal sectional view with the representation of a thread path, in FIG. 2 is shown a cross sectional view without the thread path, and in FIG. 3 a top view of the illustrative embodiment. Insofar as no express reference is made to one of the figures, the following description applies to all figures.

The illustrative embodiment of the apparatus according to the invention for the melt spinning and cooling of multifilament threads of polyamide has a spinning beam 1, which on its bottom side 12 holds a plurality of spinnerets 2 arranged side by side in rows. The spinnerets 2 are connected within the spinning beam 1 by a plurality of melt lines 6 to a spinning pump 3. The spinning pump 3 is driven by means of a pump drive, wherein the spinning pump 3 to each spinneret 2 has a separate conveying means. The spinning pump 3 is connected to a melt source (not represented here) via a melt inflow 5. The spinning beam 1 is of heated design, so that the spinnerets 2, the melt line 6 and the spinning pump 3 are heated.

To the spinning beam 1 is assigned on the bottom side 12 a connection adapter 13. The connection adapter 13 has for each spinneret 2 respectively a passage 16, which adjoins the bottom side 12 of the spinning beam 1.

As can be seen, in particular, from FIG. 2, the passage 16 in the connection adapter 13 forms a fine-spinning space 21, which extends beneath the spinneret 2. FIG. 2 shows only one spinning site of the spinning position, wherein the spinning sites within the spinning position—in this case four spinning sites—are identically configured. In this respect, the description to FIG. 2 applies to each of the represented spinning sites.

On the passage 16 are configured a plurality of waste gas openings 19, which are configured on a pitch circle, evenly distributed on the periphery of the passage 16. The waste gas openings 19 are formed in this illustrative embodiment by bores. In principle, the waste gas openings 19 can also be formed by oval or slotted cutouts.

The waste gas openings 19 in the passage 16 open out into a waste gas chamber 14 within the connection adapter 13. The waste gas chamber 14 extends between a closed top side 17 of the connection adapter 13 and a closed bottom side 18 of the connection adapter 13. The waste gas chamber 14 is configured annularly within the connection adapter and encloses the passage 16. On a longitudinal side of the connection adapter 13 is configured a waste gas outlet 37, to which a waste gas socket 25 is connected. The waste gas outlet 37 connects the waste gas chamber 14 to the waste gas socket 25. A free end of the waste gas socket 25 emerges in a waste gas store 36.

For the further illustration of the waste gas system, reference is made in particular, apart from to FIG. 3, also to FIG. 4. In FIG. 4, a schematic view of the connection adapter is represented.

The connection adapter 13 has, in total, four passages 16 and four inner waste gas chambers 14. Each of the waste gas chambers 14 is connected to a separate waste gas socket 25. The waste gas sockets 25 are arranged on a longitudinal side of the connection adapter 13. The waste gas sockets 25 each have a waste gas duct, through which a waste gas stream is conducted outward out of the respective waste gas chambers 14.

As can be seen from the representation in FIGS. 2 and 3, the waste gas sockets 25 open with a free end within the waste gas store 36. The waste gas store 36 extends parallel to the connection adapter 13. The waste gas store 36 is connected in the waste gas duct 38 to a disposal station 39 not represented in detail here. Within the disposal station 39, a treatment and separation of the waste gases takes place, so that the monomers and oligomers, for instance, can be disposed of.

As can be seen from the representations in FIGS. 1 and 2, the connection adapter 13 is supported against a pressure plate 20, which is arranged on the bottom side 12 of the spinning beam 1. In this illustrative embodiment, the connection adapter 13 is thus held over a directly adjoining cooling device 4. The pressure plate 20 arranged on the bottom side 12 of the spinning beam 1 could also be shielded from the heated spinning beam 1 by an insulating material not represented here.

In this illustrative embodiment, the cooling device 4 is formed by a blow box 8, which in its top side 11 bears the connection adapter 13. In the blow box 8 forms an upper blow chamber 9 and a lower distributing chamber 10, wherein the upper blow chamber 9 and the lower distributing chamber 10 are separated from each other by a perforated plate 26.

Within the blow chamber 9, the blow box 8 has coaxially to the passages 16 of the connection adapter 13 a plurality of cooling cylinders 23. The cooling cylinders 23 form on the top side 11 of the blow box a plurality of inlet openings 15, which are oriented coaxially to the passages 16 of the connection adapter 13. The cooling cylinders 23 are all configured identically within the blow chamber 9 and have a gas-permeable cylinder wall, which can be formed, for instance, in double-walled design with an inner perforated plate and an outer wire mesh or with metal gauze.

In the vertical direction, to the cooling cylinders 23 are assigned a plurality of passage cylinders 27, which are open toward both ends and which each have closed cylinder walls and penetrate the lower distributing chamber 10. The blow box 8 is thus fully penetrated, from the top side to an outlet side, by the cooling cylinders 23 and the passage cylinders 27.

The blow box 8 has on a longitudinal side an air duct 24, which opens out into the lower distributing chamber 10. The air duct 24 is connected via an air supply duct 29 to a compressed air source not represented here in detail. Within the air supply duct 29 is configured a pressure adjusting means 30. In this illustrative embodiment, the pressure adjusting means 30 is formed by an adjustable damper flap 31.

As can be seen, in particular, from the representation in FIG. 1, the blow box 8 has in the region of the blow chamber 9 a measuring port 32, in order to measure an air pressure within the blow chamber 9. At the measuring port 32 is arranged, in this illustrative embodiment, a stationary pressure gauge 33, in order to indicate the air pressure prevailing within the blow chamber 9.

For the sealing and insulation, on the top side 11 of the blow box 8 is provided an insulating plate 22, which extends between the connection adapter 13 and the blow box 8.

For the vertical adjustment of the blow box 8 are provided two separate piston cylinder units 28.1 and 28.2, which on an outlet side are directly coupled with the blow box 8. During operation, the blow box 8 is pressed with the connection adapter 13 against the bottom side 12 of the spinning beam 1 or against the pressure plate 20, respectively. In compact configurations, to the blow box 8 is usually assigned just one of the represented piston cylinder units, which preferably acts in the middle region of the blow box 8.

During operation, a melt consisting of a polyamide, for instance a PA6 or PA6.6, is fed to the spinning pump 3 and is forwarded under pressure to the spinnerets 2. The spinning beam 1 comprising the, in total, four represented spinnerets 2 constitutes a spinning position, in order to produce four multifilament threads in, in total, four spinning sites.

At this point it should basically be mentioned that the spinning positions can have a plurality of spinnerets arranged in a single or double row. The number of represented spinnerets 2 is thus exemplary.

Each of the spinnerets 2 extrudes a multiplicity of filaments 7, which on the bottom side of the spinneret 2 pass out through a nozzle plate, not represented in detail here, having a multiplicity of nozzle openings. The filaments 7 form a filament bundle. In the extrusion of the filaments, volatile constituents, in particular monomers and oligomers, are here generated in the adjacent fine-spinning space 21, which are distributed as a waste gas in the fine-spinning space 21 and are blown out of the fine-spinning space 21 through the waste gas openings 19 by virtue of a positive pressure created by the blow chamber 8 of the cooling device 4. The waste gases are conducted via the waste gas openings 19 into the adjacent waste gas chambers 14 and are guided from there, via the waste gas sockets 25, into the waste gas store 36.

For the cooling of the filament strands, the cooling air stream generated by the blow chamber 9 and the cooling cylinders 23 is directed directly onto the filaments. After this, the filaments 7 pass through the following passage cylinders 27 and leave the blow box on the outlet side.

In order to be able to utilize the exiting cooling air stream in the to blow out the waste gases the fine-spinning space 21 and to cool the filaments, a specific air pressure must be set within the blow chamber 9 at the start of the process. For this purpose, the air supply of the compressed air source is able to be varied via the damper flap 31 and directly monitored via the measuring port 32 on the blow box 8 and the pressure gauge 33. The setting of the air pressure within the blow chamber 9 is chosen such that the waste gases can be reliably discharged at the free ends of the waste gas sockets 25. The collection of the waste gases by a waste gas store 36 and a subsequent disposal of the waste gases is thus possible. In parallel, care should here be taken to ensure, however, that the cooling air stream acting directly on the filaments produces a sufficient cooling effect.

In that illustrative embodiment of the apparatus according to the invention which is represented in FIGS. 1 to 3, the waste gases generated beneath the spinnerets are evacuated separately for each spinning site. Thus a mutual influencing of the fine-spinning spaces extending between the spinnerets and the cooling cylinders is not possible.

In order to improve the evacuation of the waste gases by the generated blow stream at the passages of the connection adapters, in FIG. 5 an illustrative embodiment of a waste gas conduit at a spinning site is shown schematically by a cross sectional view of the connection adapter in the region of a spinning site. As represented in FIG. 5, the passage 16 has a round cross section, wherein the spinneret arranged above the connection adapter 13 likewise contains a round nozzle plate for the extrusion of the filaments. The passage 16 encloses a fine-spinning space 21, in which the filaments are guided. The passage 16 is of closed configuration and has a plurality of waste gas openings 19, which are configured in evenly distributed arrangement on the periphery of the passage. The waste gas openings 19 are in this case formed by bores.

The passage 16 is surrounded by a waste gas chamber 14 configured within the connection adapter 13. The waste gas chamber 14 has on a longitudinal side of the connection adapter 13 a waste gas outlet 37. A conducting means 40 is assigned to the waste gas outlet 37 in order to conduct the waste gas entering the waste gas chamber 14 via the waste gas outlet 37 into the waste gas socket 25. Very continuous blow flows are thus able to be realized for the evacuation of the waste gas.

In principle, there is also the possibility, however, of arranging on the connection adapter 13 a plurality of waste gas sockets per spinning site. Thus, in FIG. 6, an illustrative embodiment of a connection adapter is represented schematically in a cross sectional view, wherein just one spinning site having a passage 16 is shown. The passage 16 has a plurality of waste gas openings 19, which are of slotted configuration and are configured in plural, distributed on the circumference of the passage 16. The waste gas openings 19 open out into a waste gas chamber 14 within the connection adapter 13, wherein the waste gas chamber 14 is connected, to both longitudinal sides of the connection adapter 13, to respectively a waste gas outlet 37.1 and 37.2. To the waste gas outlets 37.1 and 37.2 are connected the oppositely arranged waste gas sockets 25.1 and 25.2. The waste gas can thus be blown out of the fine-spinning space 21 to both sides of the connection adapter 13. This embodiment can advantageously be used, in particular, if there is a high incidence of waste gases.

In the illustrative embodiment represented in FIG. 1, the connection adapter is integrated on the top side of the blow box. In principle, there is also the possibility, however, of connecting the connection adapter fixedly to the spinning beam 1. An illustrative embodiment of this type is represented in FIGS. 7 to 9. FIG. 7 shows schematically a longitudinal sectional view of the entire spinning site of the illustrative embodiment, FIG. 8 shows a cross sectional view of one of the spinning sites, and FIG. 9 shows schematically a view of the connection adapter. Insofar as no express reference is made to one of the figures, the following description applies to both figures.

The illustrative embodiment according to FIGS. 7 and 8 is substantially identical to the abovementioned illustrative embodiment according to FIGS. 1 and 2, so that, at this point, only the differences are explained and otherwise reference is made to the abovementioned description.

In the illustrative embodiment represented in FIGS. 7 and 8, the connection adapter 13 is arranged on the bottom side 12 of the spinning beam 1. The connection adapter 13 is in this illustrative embodiment of multipart configuration and has for each passage an inner ring 34, which is integrated in a base plate 35 of the connection adapter 13. In this case, between the inner ring 34 and the base plate 35 is respectively configured a slotted waste gas opening 19, which connects the fine-spinning space 21 to a waste gas chamber 14 integrated in the base plate 35. The inner ring 34 forms jointly with the base plate 35 a passage 16 beneath the spinneret 2.

For the further illustration of the connection adapter 13, reference is additionally made to FIG. 9, which represents schematically a view of the connection adapter. The base plate 35 of the connection adapter 13 extends over all spinnerets and thus has, in total, four passages 16. The waste gas chamber 14 configured within the base plate 35 extends over all passages 16, so that the waste gases exiting the spinning spaces 21 via the waste gas openings 19 are blown jointly into the waste gas chamber 14.

On a longitudinal side of the connection adapter 13 is provided a central waste gas socket 25, which is connected via a waste gas outlet 37 to the waste gas chamber 14.

As can be seen from the representations in FIGS. 7 and 8, on the bottom side 18 of the connection adapter 13 is arranged a pressure plate 20. The pressure plate 20 is fixedly coupled with the connection adapter 13, so that the blow box 8 bears with an insulating plate 22 directly against the pressure plate 20. The blow box 8 is thus able to be guided relative to the connection adapter 13 into a maintenance position.

In the illustrative embodiment represented in FIGS. 7 and 8, the cooling air provided by the blow chamber 9 is utilized to blow the waste gases out of the fine-spinning space 21 and to cool the filaments within the cooling cylinders 23. Those adjustments of the air pressure within the blow chamber 9 which are necessary for this are made by means of the pressure adjusting means 30 arranged in the air supply duct 29. In this illustrative embodiment too, the pressure adjusting means 30 is formed by a damper flap 31. It should basically be mentioned, however, that also an adjustable pressure source could be utilized directly to adjust the air pressure. It is here essential that the spinning sites assigned to the blow box can be operated uniformly.

A further alternative in particular to the adjustment of the positive pressure for blowing out the waste gases could also be formed by an adjustable drain flow restrictor. The drain flow restrictor could be integrated in the waste gas socket in order to influence the blow stream and ultimately the positive pressure atmosphere in the fine-spinning space. Thus, in the embodiment represented in FIG. 3 a separate drain flow restrictor could be assigned to each of the waste gas sockets 25, or in the embodiment represented in FIG. 9 a central drain flow restrictor could be assigned. The drain flow restrictor or the drain flow restrictors could be used alternatively or additionally to the damper flap as pressure adjusting means. In the case that the drain flow restrictor is assigned to the blow box as pressure adjusting means for adjusting the air pressure within the blow chamber, the damper flap in the feed duct of the embodiment according to FIG. 1 could be dispensed with.

In the illustrative embodiment represented in FIGS. 7 and 8, a waste gas store is not represented. In principle, to the free end of the waste gas socket could be assigned a suction hood, which collects the blown-out waste gas and evacuates it, by means of a suction flow, to a disposal station. It is essential that the free end of the waste gas socket 25 opens out into a pressureless external environment. For this purpose, a possible embodiment of the apparatus according to the invention is shown in FIG. 10.

In FIG. 10, a cross sectional view of a further illustrative embodiment of the apparatus according to the invention is represented schematically. The illustrative embodiment according to FIG. 10 is substantially identical to the illustrative embodiment according to FIGS. 1 and 2, so that, in order to avoid repetitions, only the differences are explained here and otherwise reference is made to the abovementioned description.

In the illustrative embodiment represented in FIG. 10, a connection adapter 13 is fastened to a top side 11 of a blow box 8 of the cooling device 4. Between the connection adapter 13 and the top side 11 of the blow box 8 is arranged an insulating plate 22. The blow box 8 is vertically adjustable with the connection adapter 13 and, in the operating state, is held against a pressure plate 20 of a spinning beam 1. Herein, a further seal that is not represented here is usually arranged between the pressure plate 20 and the connection adapter 13.

The connection adapter 13 has a passage 16, which encloses a fine-spinning space 21 configured substantially concentrically to a spinneret 2. The passage 16 has a waste gas opening 19, which is of slotted configuration and extends over a part of the periphery of the passage 16. The waste gas opening 19 opens out into laterally configured waste gas chamber 14. To the waste gas chamber 14 is assigned, at the connection adapter 13, a waste gas outlet 37. The waste gas outlet 37 opens out into a waste gas socket 25, which is fastened to the connection adapter 13. A free opposite end 41 of the waste gas socket 25 opens out directly into an external environment, so that a waste gas discharged from the waste gas socket 25 can pass freely into the external environment.

For the take-up and evacuation of the waste gases, a suction socket 42, connected to an extraction device 44, is provided. The suction socket 42 is arranged with a suction opening 43 at a distance to the free end of the waste gas socket 41. The distance provided between the waste gas socket 25 and the suction socket 42 is labeled in FIG. 10 with the identifying letter A. The distance A is dimensioned, in dependence on the suction force of the suction socket 42, such that the blow stream generated at the waste gas socket 25 is uninfluenced.

The waste gases must be able to be discharged into the external environment at the waste gas socket 25 without affecting a suction effect of the suction socket 42. The suction effect produced by the suction socket 42 is designed such that only those waste gases which float around freely in the external environment are taken up and evacuated. As a result of the external environment, a reliable pressure decoupling between a blowing effect at the waste gas socket 25 and a suction effect at the suction socket 42 must be realized.

In the connection adapter 13 represented in FIG. 10, the waste gas chamber 14 is assigned to the waste gas opening 19 in locally bounded arrangement laterally to the fine-spinning space 21. In this respect, the connection adapter 13 has per spinneret 2 respectively a waste gas chamber 14 and a waste gas outlet 37. To the waste gas sockets 25 assigned to the waste gas outlets 37 could thus be assigned a plurality of suction sockets 42 or a central suction socket 42 with slotted suction opening 43.

In the illustrative embodiment represented in FIG. 10, the suction socket 42 could alternatively be assigned directly to the waste gas outlet 37 at the connection adapter 13. In this case, a sufficient distance must likewise be maintained so as not to influence the blow flow generated at the waste gas outlet 37. The illustrative embodiment represented in FIG. 10 could therefore also be used without a waste gas socket 25.

Similarly, it would be possible for the waste gas opening 19, the waste gas chamber 14 and the waste gas outlet 37 to be formed in the connection adapter 13 by a continuous waste gas duct laterally to the fine-spinning space 21.

In the represented illustrative embodiments of the connection adapter 13, only some of the possible configurations of the waste gas opening 19, the waste gas chamber 14 and the waste gas outlet 37 are shown. Fundamental to the invention is the generation of a blow stream from the fine-spinning space 21 into an external environment.

In the illustrative embodiment according to FIG. 10, the function for generating a blow stream at the waste gas outlet 37 is identical to the abovementioned illustrative embodiments. Thus, by adjusting the air pressure within the blow chamber 9, both the cooling of the filaments and the outblowing of the waste gases is regulated.

The method according to the invention and the apparatus according to the invention are in particular suitable for producing synthetic threads having fine filaments. An entrainment of the waste gases through the filament bundle is advantageously avoided by the cooling air stream which is generated by the blow chamber.

The invention claimed is:

1. An apparatus for melt spinning and cooling of multifilament threads of a polyamide, comprising multiple spinnerets on a bottom side of a spinning beam, comprising a blow box, which is connected to a compressed air source and which has, within a blow chamber, multiple cooling cylinders with gas-permeable walls, which cooling cylinders respectively form multiple inlet openings on a top side of the blow box, and comprising a connection adapter, which is held in a pressure-tight manner with respect to the blow box and with respect to the spinning beam and, per spinneret, at a passage, has at least one waste gas opening for the evacuation of waste gases, wherein to the blow box is assigned a pressure adjusting means for the adjustment of an air pressure within the blow chamber, by means of which an air pressure for blowing out the waste gases at the waste gas openings of the connection adapter can be set, wherein the waste gas openings are not connected to a suction device.

2. The apparatus as claimed in claim 1, wherein the blow box has a measuring port for measuring an air pressure within the blow chamber.

3. The apparatus as claimed in claim 1, wherein the pressure adjusting means is formed by an adjustable damper flap in a feed duct which opens out into the blow box.

4. The apparatus as claimed in claim 1, wherein the waste gas openings in the connection adapter are of slotted, round or oval configuration and extend individually, or in plural, at the passages, coaxially to the cooling cylinders.

5. The apparatus as claimed in claim 4, wherein to the waste gas openings within the connection adapter are assigned, per spinneret, at least one of a plurality of waste gas sockets for blowing out the waste gases, wherein the waste gas openings open out into one of multiple waste gas chambers.

6. The apparatus as claimed in claim 4, wherein to the waste gas openings within the connection adapter is assigned a common waste gas chamber, which is connected to a central waste gas socket for blowing out the waste gases.

7. The apparatus as claimed in claim 1, wherein a waste gas store is provided for the reception of the blown-out waste gases, wherein the waste gas store is connected to a disposal station.

8. The apparatus as claimed in claim 5, wherein the waste gas socket or the waste gas sockets open out with a free end into an external environment, and in that a suction socket connected to an extraction device and having a suction opening is assigned, at a distance (A) apart, to the free end of the waste gas socket or to the free ends of the waste gas sockets.

9. The apparatus as claimed in claim 1, wherein the blow box forms an upper blow chamber and a lower distributing chamber.

10. The apparatus as claimed in claim 9, wherein the upper blow chamber and the lower distributing chamber are separated from each other by a perforated plate.

11. The apparatus as claimed in claim 9, wherein in a vertical direction, to the cooling cylinders are assigned a plurality of passage cylinders, which are open toward both ends and which each have closed cylinder walls and penetrate the lower distributing chamber.

12. The apparatus as claimed in claim 1, wherein a waste gas chamber is configured annularly within the connection adapter and encloses the passage.

13. The apparatus as claimed in claim 1, wherein a cooling air stream generated by the blow chamber and the cooling cylinders is directed directly onto the filaments.

14. The apparatus as claimed in claim 1, wherein, for vertical adjustment of the blow box, two separate piston cylinder units are provided, which on an outlet side are directly coupled with the blow box.

* * * * *